United States Patent [19]

Hug et al.

[11] Patent Number: 4,751,056

[45] Date of Patent: Jun. 14, 1988

[54] REACTOR FOR THERMALLY CRACKING FLUOROHYDROCARBONS

[75] Inventors: Siegismut Hug, Wiesbaden-Breckenheim; Jürgen Korinth, Hofheim am Taunus; Wolfgang Handke, Frankfurt am Main, all of Fed. Rep. of Germany

[73] Assignee: Hoechst Aktiengesellschaft, Fed. Rep. of Germany

[21] Appl. No.: 896,662

[22] Filed: Aug. 14, 1986

[30] Foreign Application Priority Data

Aug. 16, 1985 [DE] Fed. Rep. of Germany ..... 3529309

[51] Int. Cl.[4] ..... B01J 19/02; C01B 7/19

[52] U.S. Cl. ..... 422/194; 422/193; 422/202; 423/483

[58] Field of Search ..... 422/158, 189, 193, 194, 422/202; 423/483

[56] References Cited

U.S. PATENT DOCUMENTS

| | | | |
|---|---|---|---|
| 2,318,688 | 5/1943 | Hasche et al. | 422/193 |
| 2,552,277 | 5/1951 | Hasche | 422/193 |
| 3,190,730 | 6/1965 | Korwin et al. | 422/193 |
| 4,198,384 | 4/1980 | Robinsn | 423/240 |
| 4,246,236 | 1/1981 | Gioacchino et al. | 422/202 |

FOREIGN PATENT DOCUMENTS

| | | | |
|---|---|---|---|
| 558751 | 7/1957 | Belgium | 422/202 |

*Primary Examiner*—David L. Lacey

*Attorney, Agent, or Firm*—Connolly and Hutz

[57] ABSTRACT

A tubular reactor for thermally cracking fluorohydrocarbons has a burner system (1) with feed lines (3, 4, 6, 7) for a mixture of fluorohydrocarbon and fuel gas and for flushing gas and oxygen or air provided at one end of the tubular reactor. This burner system delimits the end face of a combustion chamber (2) which, near the burner system, is provided with an ignition branch (9) and devices (10, 11, 12, 13, and 14) for feeding and distributing a liquid. The combustion chamber is adjoined by an absorber of cylindrical blocks (21) with bores (22) parallel to the reactor axis for a liquid product stream and a gas discharged from the combustion chamber. The bores lead into a downstream annular chamber (28) which is provided with a branch (29) for discharging gas and liquid. The other end of the reactor has a pressure relief orifice (33) which is connected via a duct (32) to the combustion chamber (2).

8 Claims, 2 Drawing Sheets

REACTOR FOR THERMALLY CRACKING FLUOROHYDROCARBONS

The invention relates to equipment for incinerating fluorohydrocarbons and comprises a tubular reactor.

Cylindrical reactors of nickel or nickel alloys for the incineration of fluorinated carbon compounds are known. The components which are to be converted are charged at the top of the reactors and the hot gases leave the reactors on the opposite side and are passed through lines to a cooling and absorption system.

The object of the invention is to provide equipment of the abovementioned type, from which saleable hydrofluoric acid and/or hydrochloric acid can be taken.

The object is achieved by equipment, wherein a burner system with feed lines for a mixture of fluorohydrocarbon and fuel gas and for flushing gas and oxygen or air is provided at one end of the reactor and delimits the end face of a combustion chamber which, near the burner system, is provided with an ignition branch and devices for feeding and distributing a liquid, the combustion chamber is adjoined by an absorber of cylindrical blocks with bores parallel to the reactor axis for a liquid product stream and a gas discharged from the combustion chamber, which bores lead into a downstream annular chamber which is provided with a branch for discharging gas and liquid, and the other end of the reactor has a pressure relief orifice which is connected via a duct to the combustion chamber.

The reactor can be surrounded by a cooling jacket. The bores running parallel to the reactor axis can be arranged in rows in the radial direction, and the blocks can have recesses between adjacent rows of bores. The inlet sides of the bores can be provided with overflow weirs. Suitable devices for feeding and distributing a liquid are spray nozzles and overflow weirs arranged in the combustion chamber. A liquid collector with an overflow weir for the absorber can be provided between the combustion chamber and the absorber.

The advantages achieved by the invention are essentially that all types of fluorohydrocarbons, even the non-combustible types, can be thermally cracked and the highly corrosive cracking products, such as HF, Hcl and chlorine can be recovered as saleable products, for example, hydrofluoric acid and hydrochloric acid, or their formation, in particular that of chlorine, can be prevented. The reactor is compact and is divided into three functional zones: the burner system, the combustion chamber and the absorption system.

Figure 1:
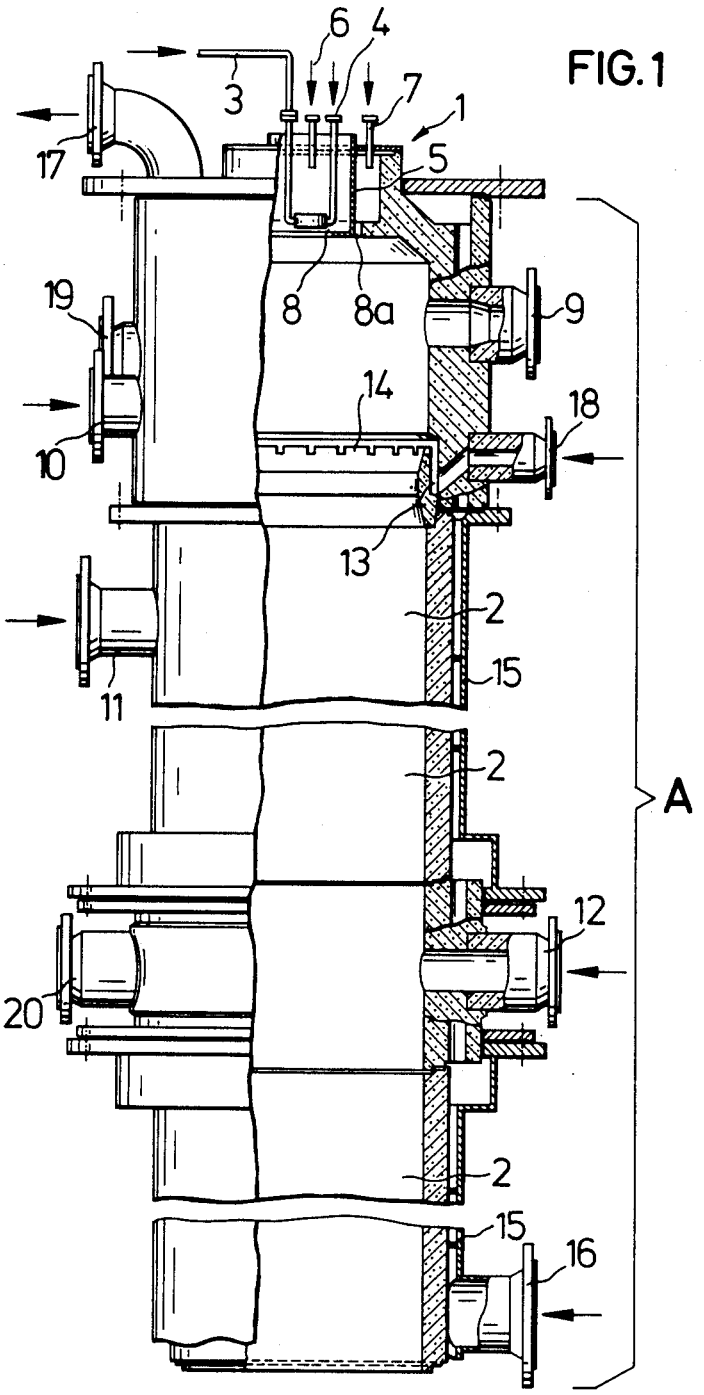
Figure 2:
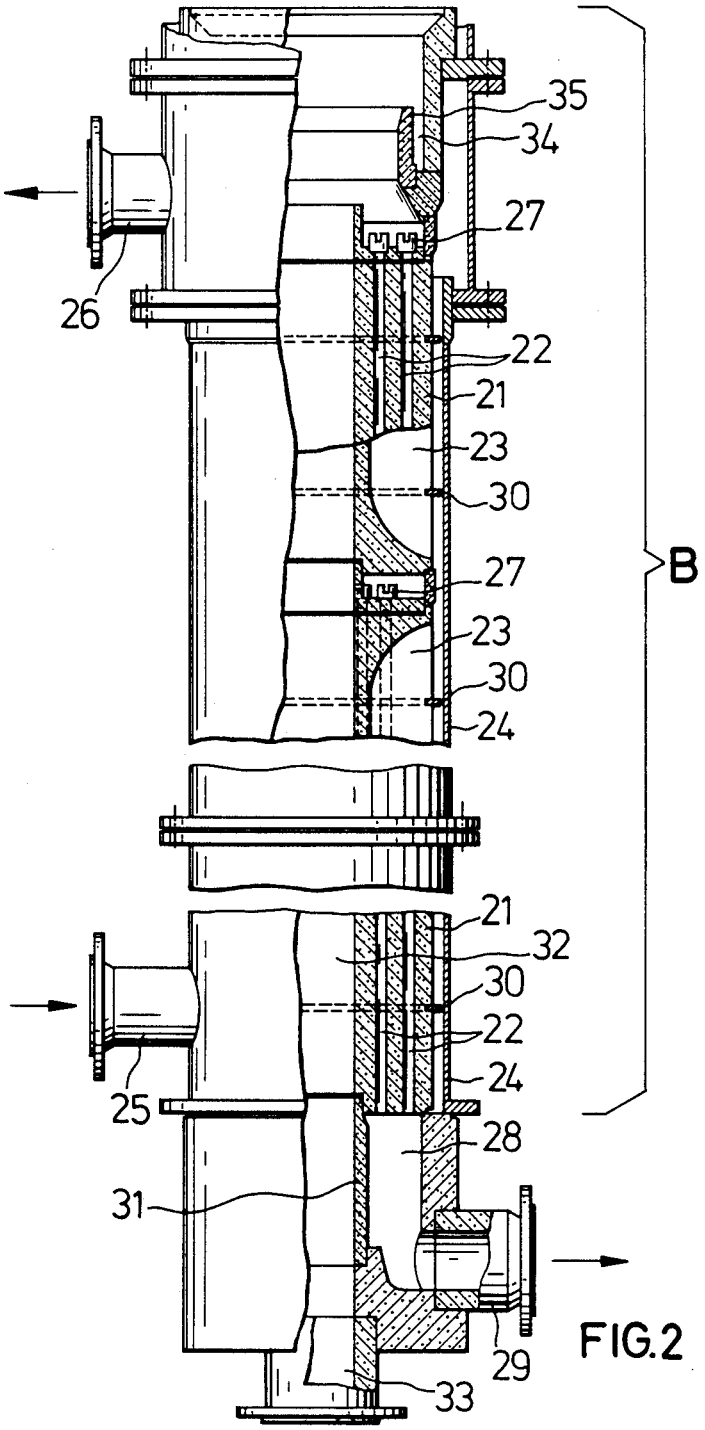

The invention is explained in more detail below by reference to drawings which represent only one embodiment and in which:

FIG. 1 shows the zone (A), used as the combustion chamber, of the tubular reactor according to the invention, partially in section and FIG. 2 shows the zone (B), designed as the absorber, of the reactor.

The burner system (1) is arranged at the top of the reactor and delimits the end face of the combustion chamber (2). The burner system can be designed as a spin burner. The gas which is to be burned and the fuel gas are fed via line (3), and oxygen or air is fed via line (4). The burner system (1) is surrounded by a housing (5) and is aligned in the reactor in such a way that the flame burns vertically downwards. Via lines (6) and (7) the interior of the housing and the outside of the housing (5) are supplied with flushing gas which, together with the annular slots (8; 8*a*), is intended to prevent corrosive products from flowing back to the burner system. The burner system can be made of stainless steel or coated stainless steel. Preferably, the reactor is made of graphite. Zone (A), serving as the combustion chamber (2) of the reactor has, near the burner system, an ignition branch (9) for igniting the flame and devices for feeding and distributing the liquid. As well known in the art, an ignition may be advanced through ignition branch 9 to ignite the burner. For such devices, liquid nozzles (10), (11) and (12), by means of which liquid can be injected into the combustion chamber (2), and/or a channel (13), which is provided with an overflow weir (14) and which is supplied with liquid by means of a liquid-charge point (18), are suitable for this purpose. The overflow weir (14) distributes the liquid as a thin film over the wall of the combustion chamber (2). Additionally, the combustion chamber can have a cooling jacket (15) which is provided with a coolant supply (16) and coolant discharge (17). The reactor zone (A) forming the combustion chamber can also be provided with an inspection hole (19) and a temperature measurement branch (20). The length of the combustion chamber can be a multiple of the combustion chamber diameter, for example 5 to 10 times the diameter. The combustion chamber (2) is adjoined by a further reactor zone (B) designed as an absorber. The absorber can comprise several cylindrical blocks (21) which are provided with bores (22) running parallel to the reactor axis. In the radial direction, several bores (22) can be arranged one after the other to form a row, and the blocks can be provided between the rows of bores (22) with radial recesses (23) which are to receive coolant. The reactor zone (B) forming the absorber is provided with a cooling jacket (24) with coolant supply (25) and coolant discharge (26). To improve turbulence of the flow and to guide the coolant, the inner wall of the cooling jacket (24) can be provided with annular baffle segments (30). The inlet sides of the bores (22) can have overflow weirs (27). The bores (22) of the absorber lead into an annular chamber (28). In the latter, the condensate is collected and discharged from the reactor together with the gases via the branch (29). The duct (32) formed by the absorber and the inner boundary (31) of the annular chamber (28) serves for pressure relief. The pressure relief orifice 33 is closed by a pressure relief device, for example a bursting disk or a dip seal (not shown). A liquid collector (34) with an overflow weir (35) can be provided between the combustion chamber (2) and the absorber.

As a result of the adjustable flame pattern and of the cooling of the combustion chamber wall, wall temperatures below 100° C. can be reached with the desired slender combustion chamber design. It is therefore possible to use graphite, which has good corrosion resistance against all combustion products. Additional protection against thermal and corrosive destruction of the graphite is provided by the possibility of adding a liquid, preferably water or aqueous hydrofluoric acid, via a weir at the top of the combustion chamber, in order to produce a liquid film on the inner combustion chamber wall. In addition, it is possible to feed a liquid, preferably water or aqueous hydrofluoric acid, into the combustion chamber at various points, in order to adjust the flame temperature and the reaction equilibrium.

The equipment is arranged vertically. The flame is controlled to burn downwards. All condensed combustion products and additional quantities of solution, via an overflow weir or by injection, run from the high temperature zone to the low temperature zone and can be withdrawn, in the cooled state, at the lower branch (29). The coolant stream preferably flows in countercurrent thereto.

We claim:

1. A tubular vertically arranged down stream reactor for thermally cracking fluorohydrocarbons, the reactor having first and second ends and comprising a burner system located at the first end of the reactor so as to define one end of a combustion chamber, the burner system having feed lines at the first end of the reactor for a mixture of fluorohydrocarbon and fuel gas and for flushing gas, an ignition branch positioned and arranged for advancing an ignition to the burner system and devices positioned and arranged for feeding and distributing a liquid into the combustion chamber, an absorber comprising cylindrical blocks positioned below the combustion chamber, the tubular reactor having a longitudinal axis and the absorber having bores therein running parallel to the longitudinal axis of the reactor and having inlet sides facing the combustion chamber and discharge sides for a liquid product stream and a gas discharged from the combustion chamber, said reactor being constructed so as to define an annular chamber at the discharge ends of the bores in the absorber, a branch connected to the annular chamber for discharging gas and liquid, and a pressure relief orifice at the second end of the reactor downstream from the absorber and connected to the combustion chamber by a duct.

2. A tubular reactor as in claim 1 including a cooling jacket surrounding the reactor and wherein the bores running parallel to the reactor axis are arranged in rows in a radial direction relative to the reactor axis, and wherein the cylindrical blocks of the absorber have recesses between adjacent rows of the bores.

3. A tubular reactor as in claim 1 wherein overflow weirs are arranged on the inlet sides of the bores.

4. A tubular reactor as in claim 1 wherein some of the devices for feeding and distributing liquid into the combustion chamber comprise spray nozzles.

5. A tubular reactor as in claim 1 wherein one of the devices for feeding and distributing liquid into the combustion chamber comprises a channel with an overflow weir.

6. A tubular reactor as in claim 1 including a liquid collector having an overflow weir positioned between the combustion chamber and the absorber.

7. A tubular reactor as in claim 1 wherein the burner system is made out of metallic material.

8. A tubular reactor as in claim 1 further including a flushing chamber defined by a housing surrounding the burner system, which flushing chamber is provided with slots connecting the flushing chamber with the combustion chamber and said flushing gas feed line is connected to said flushing chamber.

* * * * *